US005607361A

United States Patent [19]

Mastandrea et al.

[11] Patent Number: 5,607,361

[45] Date of Patent: Mar. 4, 1997

[54] ELECTRONIC DEVICE FOR SIGNALING WRIST POSITION DURING A GOLFER'S SWING

[75] Inventors: William J. Mastandrea, Palm Beach County, Fla.; Donald R. Curtis, Pulaski County, Ky.

[73] Assignee: Back Swing Management, Inc., Boca Raton, Fla.

[21] Appl. No.: 341,766

[22] Filed: Nov. 18, 1994

[51] Int. Cl.[6] ..... A63B 69/36

[52] U.S. Cl. ..... 473/207; 473/213; 473/276; 473/59; 473/458

[58] Field of Search ..... 273/35 R, 26 C, 273/29 A, 186.1, 186.2, 187.2, 187.1; 73/505, 516 LM, 517 A, 865.4; 128/774, 782; 343/718; 340/574; 473/55, 59, 207, 212, 266, 276, 213

[56] References Cited

U.S. PATENT DOCUMENTS

| | | | |
|---|---|---|---|
| 3,350,100 | 10/1967 | Carmines | 273/183 |
| 3,362,023 | 1/1968 | McMahon | 340/279 |
| 3,368,817 | 2/1968 | Duncan | 273/183 |
| 3,528,664 | 9/1970 | Gunn, Jr. | 273/183 |
| 3,717,857 | 2/1973 | Evans | 340/177 |
| 3,766,538 | 10/1973 | Dealy | 340/279 |
| 3,860,245 | 1/1975 | Yamada | 273/183 B |
| 3,918,721 | 11/1975 | Trask | 273/186 A |
| 4,193,065 | 3/1980 | Bittner | 340/323 |
| 4,257,607 | 3/1981 | Nedwick | 273/183 |
| 4,502,035 | 2/1985 | Obenauf et al. | 340/323 B |
| 4,506,166 | 12/1985 | Emerson | 273/183 |
| 4,665,388 | 5/1987 | Ivie et al. | 340/573 |
| 4,699,379 | 10/1987 | Chateau et al. | 273/187.2 |
| 4,869,509 | 9/1989 | Lee | 273/183 |
| 5,108,104 | 4/1992 | Johnson | 273/187.2 |
| 5,354,050 | 10/1994 | McCarthy | 273/187.2 |
| 5,423,547 | 6/1995 | Puso | 273/187.2 |

*Primary Examiner*—William M. Pierce
*Attorney, Agent, or Firm*—Pitts & Brittian, P.C.

[57] ABSTRACT

A device for positioning on the back of a golfer's hand to provide the golfer with an audible signal when the golfer's wrist has a selected angular orientation during critical portions of the swing of a golf club. The device includes a pair of multicontact orientation sensitive switches, with separate or joint connection provided, such that internal electrical connections are made only when the desired angular orientation of the wrist is achieved. When such connection is made, the circuit of the device provides an audible signal that is heard by the golfer. This proper wrist orientation, and the electrical connection, must be maintained during the golf swing in order to continue the audible signal. A change in the signal indicates that the preferred orientation is not maintained. The orientation switches are disk mercury switch units having twelve internal contacts positioned at thirty degree intervals. These switches are positioned within a housing with an orientation such that the electrical contacts are made when proper wrist orientation and club swing are achieved.

16 Claims, 3 Drawing Sheets

ELECTRONIC DEVICE FOR SIGNALING WRIST POSITION DURING A GOLFER'S SWING

TECHNICAL FIELD

The present invention relates generally to a device for aiding a golfer in perfecting the grasp and swing of a golf club, and more particularly to a wrist-mounted device that provides an audible signal at a selected correct orientation of the wrist during the swing of the club.

BACKGROUND ART

There are several variables in achieving a preferred swing of a golf club by a golfer. One is the rate of movement of the club during the backswing and then the forward swing. Another is that of the angle of the wrist and arm during grasp of the club during addressing the ball and during the swing of the club. A combination of these—the wrist orientation and the swing rate—controls the direction of ball and the distance of ball travel through the air. Accordingly, a preferred swing for a particular golfer involves a backswing of a selected height, and a rate of golf club motion during the swing including the follow through. Further, this preferred swing involves maintaining a constant wrist roll during the swing as this wrist roll affects the angle of the golf club face with respect to the ball.

A beginning, or even amateur, golfer has a difficult time in remembering the proper wrist/arm positions, particularly during the follow through to achieve a desired direction and distance of ball travel. This only comes with extensive practice. However, if the golfer practices alone, there is no one to monitor the characteristics of the swing. Further, each golfer has a different grip and often uses a different club than another golfer so that instruction must be tailored for the specific golfer.

Devices have been developed as aids during the club "stroking" throughout the swing. One such device is that described in U.S. Pat. No. 3,362,023 issued to W. McMahon on Jan. 2, 1968. This device detects movement of the golfer's head beyond certain limits as a means of controlling head position during a swing. This cannot monitor arm/wrist position during the swing. Other general golf-assisting devices are described in U.S. Pat. Nos. 4,502,035 issued to J. Obenauf et al on Feb. 26, 1985; 4,560,166 issued to E. Emerson on Dec. 24, 1985; and 4,869,509 issued to S. Lee on Sep. 26, 1989.

Still another golfer's aid device is that described in U.S. Pat. No. 3,528,664 issued to G. Gunn on Sep. 15, 1970. This is a device that is worn on the wrist that has a metallic ball in a capsule that produces an audible sound when the ball strikes either end of the capsule. A more elaborate device employing the same principle, but with means for making adjustments, is described in U.S. Pat. No. 3,860,245 issued to N. Yamada on Jan. 14, 1975. A similar device to be worn at the waist of the golfer is described in U.S. Pat. No. 3,368,817.

Various devices have been developed to determine relative movement of portions of the arm, including the wrist. These are described in U.S. Pat. Nos. 3,350,100 issued to A. Carmines on Oct. 31, 1967; 3,717,857 issued to J. Evans on Feb. 10, 1973; 3,918,721 issued to J. Trask on Nov. 11, 1975; 4,193,065 issued to L. Bittner on Mar. 11, 1980; and 4,257,607 issued to A. Nedwick on Mar. 24, 1981.

Other devices generally related to body movement are disclosed in U.S. Pat. Nos. 3,766,538 issued to R. J. Dealy on Oct. 16, 1973; and 4,665,388 issued to B. Ivie on May 12, 1987.

It will be determined, from a review of these prior art devices that there is no known wrist-worn device that will provide an audible signal to a golfer when desired portions of the wrist and arm are maintained during the address of the ball, during the back swing or during the follow through of the stroke.

Thus, it is an object of the present invention to provide a device that will provide an audible signal to a golfer when a desired angular orientation of the wrist and arm are achieved so that consistency is achieved in driving the ball in a desired direction and for a desired distance.

A further object of the present invention is to provide a device that will provide an audible signal to a golfer when a desired rate of back swing and follow through are achieved during a golf swing.

It is a further object to provide a simple wrist-mounted device that will provide such a signal to a golfer when a desired orientation of the wrist and arm is achieved during the addressing of the ball and during the swing, as well as the rate of club movement during the backswing.

Another object of the present invention is to provide a device wherein the sensitivity to a desired wrist orientation can be pre-set at a selected value such that the signal will advise the golfer when the proper orientation is achieved.

It is also an object of the present invention to provide an electrical circuit that will provide a signal via an electrically operated sound element to provide an audible signal to the golfer when the preferred wrist orientation and/or swing rate are attained during the swing.

These and other objects of the present invention will become apparent upon a consideration of the drawings referred to hereinafter, and a complete description thereof.

SUMMARY OF THE INVENTION

In accordance with the present invention, there is provided a signalling device for mounting on the back of the golfer's hand adjacent the wrist of a golfer that provides an audible indication to the golfer wherein the golfer's wrist and arm have reached a selected orientation during the addressing of the ball, and during the swing of a golf club. Further, the device can selectably monitor the speed of the golf club during the backswing and follow through of the club. This device incudes a pair of orientation sensitive switches mounted in planes that are substantially perpendicular to each other, with one switch monitoring the wrist roll and the other switch monitoring the wrist angle with respect to the forearm of the golfer. This later switch can also monitor the rate of club movement. The switches, the electrical circuit therefor, a battery and a sound generator are mounted within a housing that is fastened to a golfer with a strap such that no movement occurs between the housing and the golfer. A selection switch permits choice of operating conditions.

BEST MODE FOR CARRYING OUT THE INVENTION

Figure 1:
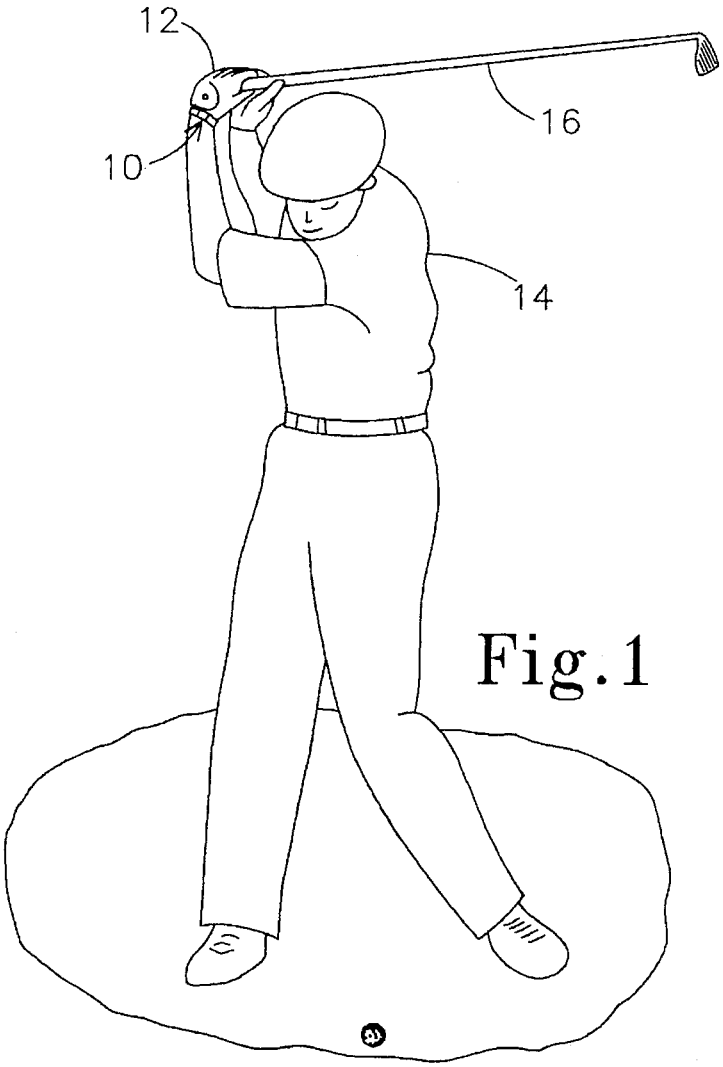
FIG. 1 is a drawing illustrating a golfer with a club at about the upper limit of a back swing showing the present signal-generating device embracing the back of the left hand of the golfer adjacent the wrist (for a right-handed golfer).

Referring first to FIG. 1, indicated at 10 therein is one embodiment of the present invention as positioned on the back of the left hand 12 of a golfer 14 at a position immediately adjacent the pisiform bone and toward the fingers of the golfer. If, however, the golfer is left handed, the device 10 would be worn on the right hand. As illustrated, the golfer 14 holds a golf club 16 at approximately the top of the back swing. As will be discussed in detail hereinafter, the device 10 can be made to provide an audible sound during the swing such that the rate of movement of the club can be monitored.

Figure 2:
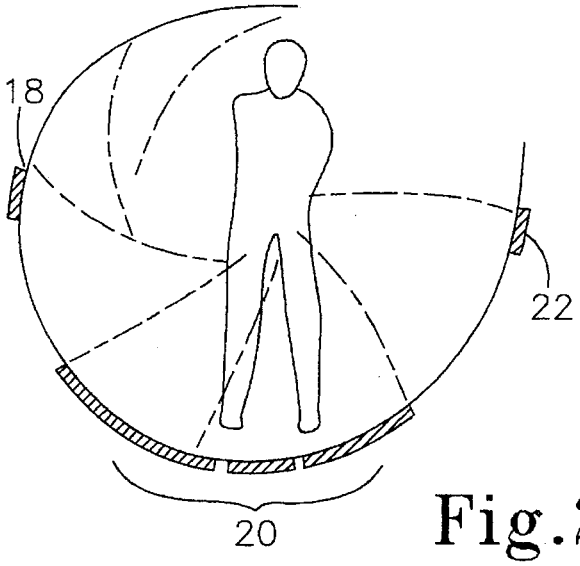
FIG. 2 is a drawing depicting critical areas during the swing of a golf club that are monitored by the present invention.

As discussed above, and in more detail hereinafter, a golfer's wrist orientation is important to being a successful golfer. Accordingly, the present invention further can be set to monitor this wrist orientation during the swing. Illustrated in FIG. 2 are the critical areas where this correct orientation of wrist is particularly needed. These areas include: the upper portion of the back swing identified at 18; the region prior to, during and immediately after the ball is struck 20; and during the follow through 22. The present invention provides a continuous audible signal if the wrist orientation is correct throughout these areas of the swing. If, however, the wrist orientation is out of tolerance, a pulsed tone or lack of tone will signal the amount of the error. Further, the present device can be set to monitor for a uniform rate of movement of the club during the swing.

Figure 3:
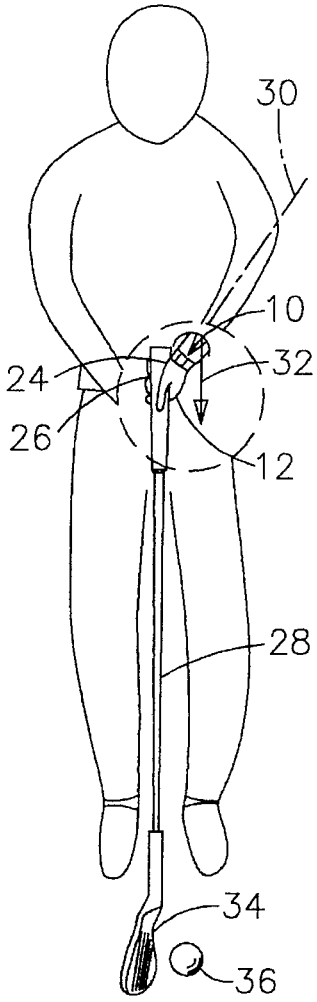
FIG. 3 is a drawing depicting angular relationships between a golfer's hand, arm, club shaft and golf club face.

As indicated above, a very important aspect of successful golfing is related to the grip of the golf club which involves the angle of the wrist relative to the forearm. Further, at the same time, the "roll" of the wrist affects the rotation of the club shaft to affect the orientation of the golf club face to a ball. These orientations can be explained by considering FIG. 3. As shown, the hand 12 is bent at the wrist 24 so as to align the thumb 26 with the axis of the club shaft 28. In the proper position, there is established a preferred angle between this axis and the axis 30 of a golfer's forearm. At the same time, there is a preferred roll of the wrist, as indicated at 32, that assures that the club face 34 is perpendicular to a direction of motion of the club as it meets a golf ball 36.

Figure 4:
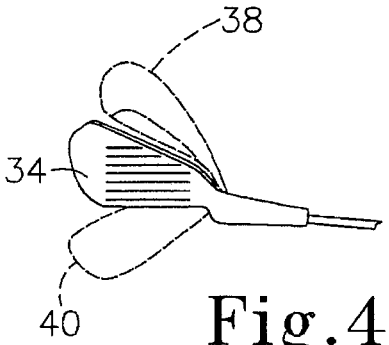
FIG. 4 illustrates how the various angular positions of the golfer's hand affect the orientation of a golf club face relative to a golf ball.

The effect of the wrist roll is illustrated in FIG. 4. Shown in solid lines is the preferred orientation of the club face 34 as it approaches the ball. However, if there is an improper orientation of the wrist rotation (roll), the club face can either be "open" as at 38, or "closed" as at 40. It is for this reason that the present device monitors this wrist roll during the swing.

Figure 5:
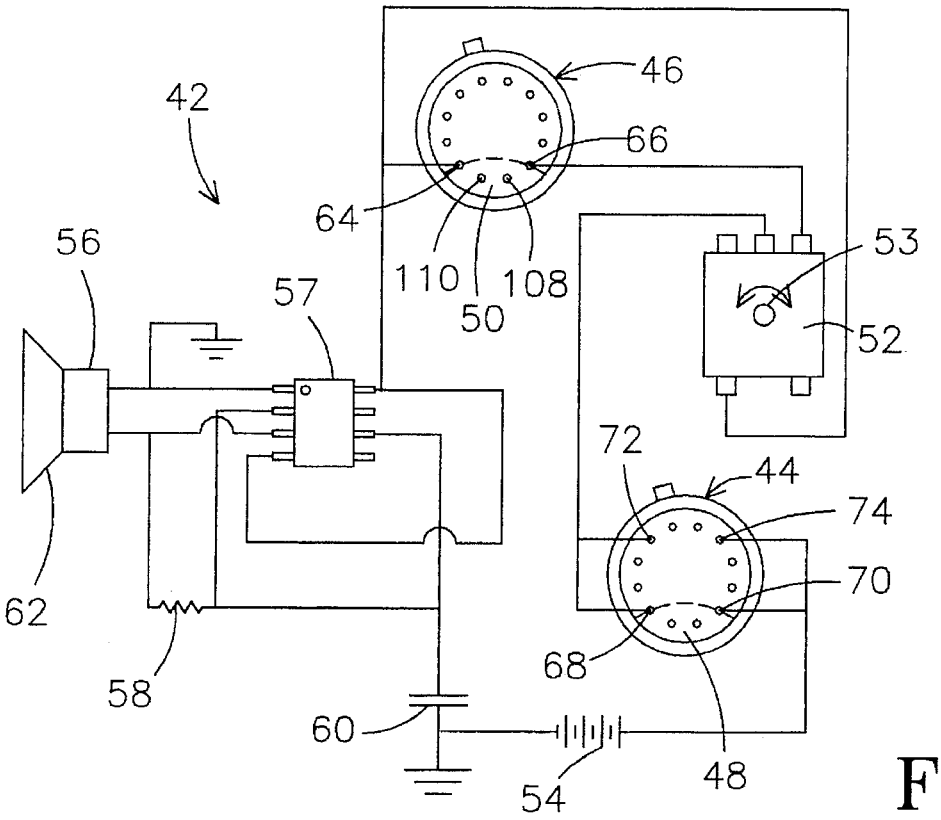
FIG. 5 is a schematic circuit drawing of an embodiment of a device to accomplish the above-stated objects.

A schematic circuit diagram of a device for accomplishing the objects of the present invention is shown at 42 of FIG. 5. The principal elements that give rise to position information are two disk multicontact mercury switches 44 and 46. Each of the switches 44, 46 have twelve internal contacts arranged uniformly at thirty degree spacing. As will be discussed in detail hereinafter, switch 44 is positioned substantially in the center of the present device 10, and switch 46 is mounted in a plane that is perpendicular to the plane of switch 44. These mercury switches are typically Item No. 2009X4-1 manufactured by Signal Systems International of Lafayette, N.J. For illustration purposes, a mercury pool 48, 50, respectively, in each of the switches 44, 46 is shown as being of sufficient size so as to contact four adjacent of the twelve contacts due to gravitational forces. It will be understood that if either of the switches is rotated about its center, the mercury pool thereof will move to other contacts (unless acted upon by centrifugal force). These two multicontact switches 44, 46 are interconnected with a selector switch 52 which permits a selection of one or the other of the switches, or the two in unison, to be active in the present device 10. Typically this switch 52, which has an operating shaft 53, is an RTE-Series switch manufactured by ITT Schadow, Inc. Each rotational position of the switch 52 provides for certain internal connections so as to achieve the desired connections to and between the switches 44, 46 Further, the switch 52 can have a position to inactivate the circuit 42. The circuit 42 is powered by a battery 54 which is typically six volts. For the purpose of providing an audible sound to a golfer that indicates the orientation of the golf club, there is a piezoelectric element 56 connected to a driver unit 58. This driver unit 56, typically Model 7NV-31R2-19R7-DM-1 manufactured by Murata Electric, together with a resistor 58 and capacitor 60 establish the frequency of the sound. In the present embodiment, a frequency of 1275± Hz was chosen so as to provide a sound that would be distinguished over ambient sounds. Of course, other frequencies could be chosen. Although a "horn" 62 is indicated, this is simply to indicate that this is the sound-producing portion of the circuit 42. As will be discussed below, the housing provided for the circuit 42 provides the horn for the distribution of the sound.

It can be seen that when the mercury pools 48, 50 are in the positions as shown, and if the switch 52 is in a position where the two switches 44, 46 are connected in series, the piezoelectric element 56 would be energized to produce sound. However, rotation of switch 46 such that electrical contact is lost between the pool 50 and the two contacts 64, 66, no sound would be produced.

Switch 44, however, has multiple internal contacts connected into the circuit 42. Thus, the mercury pool 48 thereof can connect: contacts 68 and 70; contacts 70 and 72; contacts 72 and 74; and contacts 74 and 70. Thus, there are four positions where electrical contact can be made in order to produce an audible sound to the golfer. The purpose for this will be discussed below.

Figure 6:
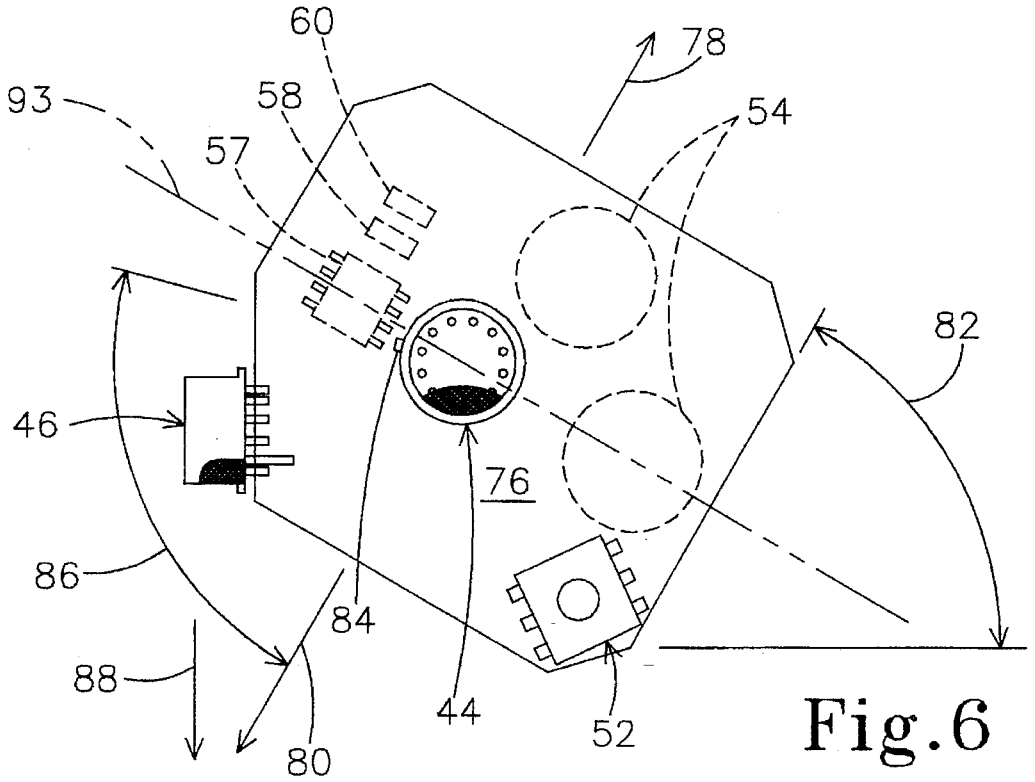
FIG. 6 is a drawing illustrating the arrangement of some of the elements of the circuit of FIG. 5 on a circuit board for incorporation into the present device.

A typical physical arrangement of the elements of circuit 42 within the present device 10 is shown in FIG. 6. Of course, it will be understood that some of this arrangement can be changed without departing from the scope of the present invention. The elements are typically mounted from a circuit board(s) 76, with interconnections between components as indicated in FIG. 5. Elements mounted beneath the board(s) 76 are indicated in dashed lines. It can be seen that multicontact mercury switch 44 is mounted such that it is in the plane of the board(s) 76 which, as will be seen below, is in a plane substantially parallel with the back of a golfer's hand. In contrast, multicontact mercury switch 46 is mounted so as to be in a plane perpendicular to the board(s) 76.

Figure 9:
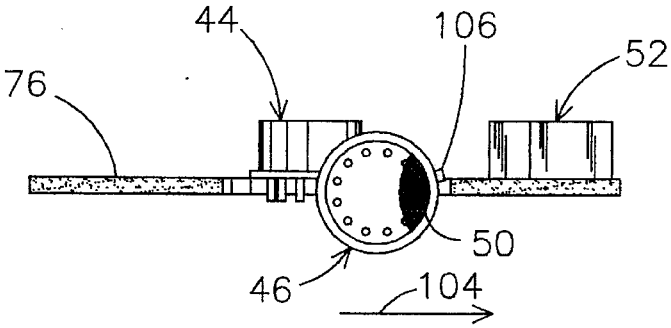
FIG. 9 ia an enlarged side elevation of the circuit board of FIG. 6 showing the relationship of the two disk-shaped multicontact mercury switches of the circuit of FIG. 6.

Shown in this FIG. 6 is the direction toward the elbow, as indicated by arrow 78, and the direction toward the hand indicated by arrow 80. Since the typical angle between the alignment of these two arrows 78, 80 and the level of ground is about sixty-two degrees, as indicated at 82, switch 44 is positioned so that electrical contact is made in this orientation between the two internal contacts indicated in FIG. 5. This is assured by the positioning of the indexing projection 84 at about seventy-five degrees from the alignment direction, with this angle being indicated by the angle at 86. This rotates the switch 44 fifteen degrees (½ of thirty degrees) to achieve the proper internal contact when a golf club is held perpendicular to the ground (direction indicated by arrow 88). There is a similar fifteen degree rotation of switch 46 also, as shown in FIG. 9, to obtain proper contact between its mercury pool 50 and internal contacts 64, 66.

Figure 7:
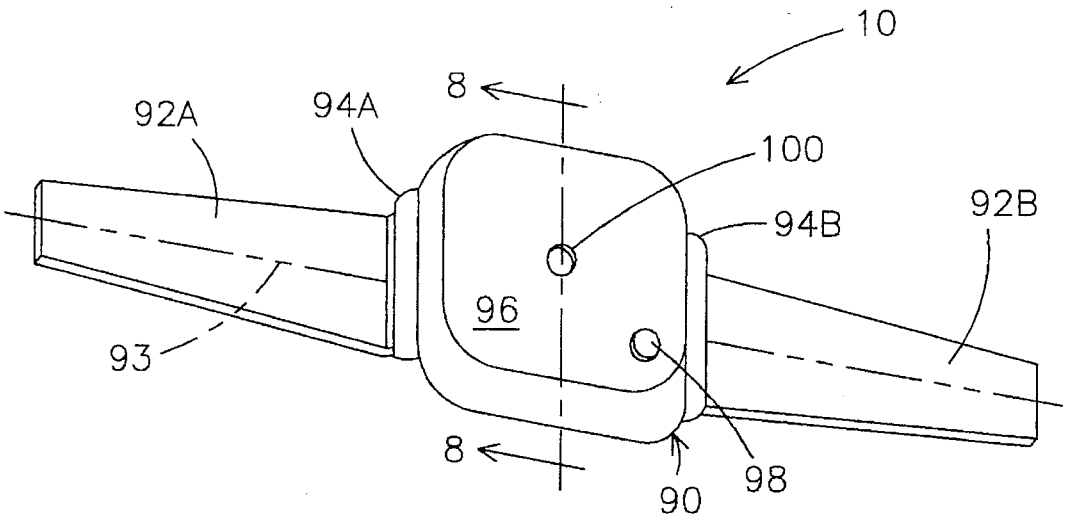
FIG. 7 is a drawing depicting one embodiment of the enclosure and attachment strap of the present device.

An external view of a typical embodiment of the present invention 10 is shown in FIG. 7. There is a housing member 90 for containing the circuit members of FIG. 5. A strap 92A, 92B provides the means for encircling the hand of a wearer. A conventional longitudinal axis of the encircling strap is indicated at 93 (see also FIG. 6). Although not shown, the opposing ends of the strap pieces 92A, 92B are joined in any conventional manner. Connection is made to the housing member 90 at extensions 94A, 94B in a manner similar to the attachment of a strap to a wrist watch. While shown as a two-piece strap, a preferred form is a continuous strap. In order that the housing member 90 is firmly affixed against the back of a users hand, the strap portions, or the complete strap if one piece, need to be flexible and of a material such that this close contact is maintained during the golf club swinging motion.

Extending upwardly from the upper surface 96 of the housing member 90 is a knob 98 that is in physical engagement with the operating shaft 53 of the selector switch 52 (see FIG. 5). This upper surface 96 is provided with a generally central opening 100 that serves as an exit port for sound produced by the piezoelectric element 56, the interior of the housing member 90 serving as the "horn" for the sound. It will be recognized, however, that the positioning of the knob 98 and the opening 100 are not critical to the operation of the device except that they must be aligned with their related components within the housing member 90.

Figure 8:
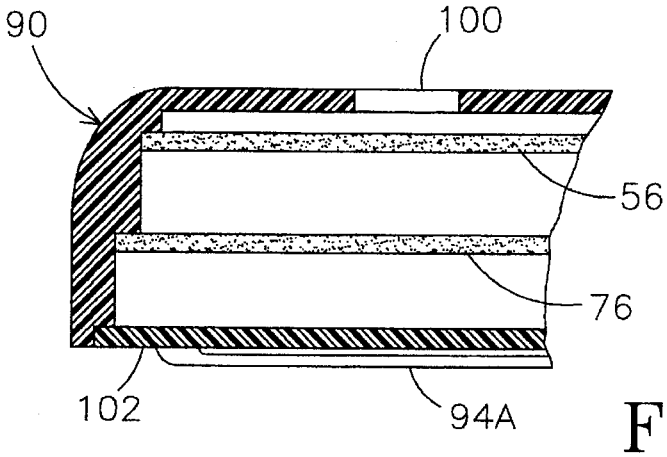
FIG. 8 is an enlarged cross-section of the device depicted in FIG. 7, taken at 8—8 thereof (partially cut away) showing the internal configuration.

An enlarged cross section of the housing member 90 is shown in FIG. 8. This housing member 90, which typically is fabricated from a moldable plastic, has an interior shoulder to support the circuit board 76 as well as a second interior shoulder to support the piezoelectric element 56. Circuit components mounted on the circuit board 76 are not shown for simplicity in this drawing. The cavity of the housing member 90 is closed with a rear cover 102 in a manner similar to the rear of a wrist watch.

FIG. 9 is a drawing illustrating the mounting of switches 44, 46 on the circuit board 76. The respective mercury pools 48, 50 are illustrated in a position as determined by gravity which, in this drawing, is indicated with the arrow 104. This view of the components shows the indexing projection 106 of switch 46, the switch 46 being rotated fifteen degrees as discussed with respect to FIG. 6 in order to obtain the necessary electrical contact when the device 10 is in proper orientation during the address of the golf ball and during the swing of the golf club.

There may be some instances where the sensitivity of the device 10 is to be reduced, allowing greater deviation from a desired orientation. This can be accomplished, for example, by connecting to different contacts of one or more of the multicontact switches. Referring again to FIG. 5, intermediate contacts 108, 110 are identified intermediate contacts 64, 66. If the circuit is connected to contact 108 rather than contact 66, it can be seen that the mercury pool 50 more easily joins two contacts (e.g., 64, 108) so that the switch 46 can move through greater angles without breaking this electrical contact. Such an alternate connection can be accomplished by providing a position of the switch 52, or the circuit can be initially wired accordingly. Similar changes of the connections to switch 44 can be made if desired.

From the foregoing it will be understood by persons skilled in the art that a device has been provided that will be of assistance in training a golfer with regard to club grip, wrist roll, swing rate related matters of the use of golf clubs. Thus, a golfer can continue to practice all of his/her techniques until they become second nature to the golfer. When all conditions of the swing meet the established conditions built into the device, the golfer will hear a substantially continuous sound. However, if deviations occur, the sound will either be intermittent or nonexistent. The golfer will soon recognize these sounds, or lack thereof, to perfect his/her swing. Thus, the golfer will be "programmed" to adopt proper hand-arm orientation during the positioning of the golf club relative to the ball, and during the swing of the club. Of course, it is expected that the device would not be used during regular play, with the device either being removed from the wrist or the circuit made inoperative by a positioning of the switch 52.

Although certain specific circuit components are identified relative to their source, it should be understood that the present invention is not limited to these specific elements. Rather, the invention is to be limited only by the appended claims and their equivalents.

We claim:

1. A device adapted to be attached to and used on the back of a golfer's hand for use by a golfer to signal a selected angular wrist roll and wrist bend during the swing of a golf club, said device comprising:

a housing having a top surface and a bottom surface and defining in internal cavity;

a strap connected to said housing adapted for fastening said housing on a back of a hand of the golfer proximate a wrist whereby when worn by the golfer said housing moves according to movement of the wrist, said strap having a longitudinal axis adapted for extending around the golfer's hand;

a first disk mercury switch mounted within said cavity at a center of said cavity and in a plane parallel to said bottom surface of said housing, said first disk mercury switch responsive to angular movement of the wrist;

a second disk mercury switch mounted within said cavity in a plane perpendicular to said bottom surface of said housing, said second mercury switch so as to be responsive to angular movement of said housing in a direction perpendicular to movement for actuating said first disk mercury switch whereby wrist roll and wrist bend during the swing provides movement of said first and second disk mercury switches;

each said first and second disk mercury switch having a disk cavity with a circular perimeter, a plurality of equally-spaced internal peripheral electrical contacts extending into said disk cavity, and a mercury pool within said disk cavity movable around said circular perimeter for contacting at least two adjacent of said electrical contacts during a rotation of said disk mercury switches around a center of said disk mercury switches;

an electrical power source within said cavity connectable to said first and second disk mercury switches;

a selector switch within said housing for selectively connecting and disconnecting said electrical power source to at least one of said first and second disk mercury switches, said selector switch operable by the golfer from exterior said housing; and an audible signal producing means within said cavity connected in series with said electrical power source and at least one of said disk mercury switches whereby, when said at least one disk mercury switch is closed, said audible signal producing means is actuated to provide an audible signal to the golfer that the selected wrist orientation is achieved during the swing of the golf club.

2. The device of claim 1 wherein said first mercury switch has twelve internal peripheral electrical contacts equally spaced within, with said mercury pool contacting four adjacent electrical contacts when said first mercury switch is rotated about its center point.

3. The device of claim 1 wherein said second mercury switch has twelve internal peripheral electrical contacts equally spaced within, with said mercury pool contacting four adjacent electrical contacts when said second mercury switch is rotated about its center point.

4. The device of claim 1 wherein said first mercury switch has an alignment pin and is positioned within said cavity at an orientation whereby said first mercury switch is closed when said longitudinal axis of said strap is at an angle of about sixty-two degrees with respect to a golf playing surface and said alignment pin is oriented seventy-five degrees with respect to a line perpendicular to said longitudinal axis of said strap, said perpendicular line being an alignment of a golfer's arm and hand when the golf club is properly gripped whereby said first mercury switch is closed when the golfers wrist is correctly oriented as the golf club strikes a golf ball.

5. The device of claim 4 wherein said first orientation sensitive switch has a plurality of combinations of internal contacts connected to said switch whereby movement of said mercury pool therein causes said first orientation sensitive switch to be closed during portions of the swing of the golf club when movement of the club is at a uniform velocity such that wrist position is monitored during the entire swing of the golf club.

6. The device of claim 1 wherein said audible signal producing means is a piezoelectric element activated by an electrical driver, and said cavity is provided with an opening to form a horn for generating said audible signal.

7. The device of claim 1 wherein said electrical power source is a battery source.

8. A device adapted for attachment and use on a back surface of a golfer's hand for use by a golfer to signal a selected angular wrist roll and wrist bend throughout the swing of a golf club, said device comprising:

a housing having a top surface and a bottom surface and defining an internal cavity;

an elastic strap connected to said housing adapted for fastening said housing on a back of a hand of the golfer proximate a wrist whereby when worn by the golfer said housing moves according to movement of the wrist, said strap having a longitudinal axis adapted for extending around the hand;

a first disk mercury switch mounted within said cavity at a center of said cavity in a plane parallel with said bottom surface of said housing, said first disk mercury switch responsive to angular movement of said housing due to angular movement of the wrist, said first disk mercury switch having a disk cavity with a circular perimeter, a plurality of equally spaced internal peripheral contacts extending into said disk cavity, and a mercury pool within said disk cavity movable around said disk cavity perimeter contacting selected adjacent of said internal contacts;

a second disk mercury switch mounted within said cavity in a plane perpendicular to said bottom surface of said housing, said second disk mercury switch responsive to angular movement of said housing in a direction perpendicular to movement for actuating said first disk mercury switch whereby wrist roll and wrist bend during the swing provides movement of said first and second disk mercury switches, said second disk mercury switch having a disk cavity with a circular perimeter, a plurality of equally spaced internal peripheral contacts extending into said disk cavity, and a mercury pool within said disk cavity movable around said circular perimeter contacting selected adjacent of said internal contacts;

a battery power source within said cavity connectable to said first and second disk mercury switches;

a selector switch within said housing for selectively connecting and disconnecting said battery power source to at least one of said first and second disk mercury switches, said selector switch operable by the golfer from exterior said housing; and an audible signal producing means within said cavity connected in series with said battery power source and at least one of said disk mercury switches whereby, when said at least one disk mercury switch is closed, said audible signal producing means is actuated to provide an audible signal to the golfer that the selected wrist orientation is achieved during the swing of the golf club.

9. The device of claim 8 wherein said first mercury switch has twelve internal peripheral electrical contacts equally spaced within, with said mercury pool contacting four adjacent electrical contacts when said first orientation sensitive switch is rotated about its center point to a selected orientation of the golfer's hand.

10. The device of claim 9 wherein said first mercury switch has an alignment pin and is positioned within said cavity at an orientation whereby said first mercury switch is closed when said longitudinal axis of said strap is at an angle of about sixty-two degrees with respect to a golf playing surface and said alignment pin is oriented seventy-five degrees with respect to a line perpendicular to said longitudinal axis of said strap, said perpendicular line being an alignment of a golfer's arm and hand when the golf club is properly gripped whereby said first mercury switch is closed when the golfers wrist is correctly oriented as the golf club strikes a golf ball.

11. The device of claim 8 wherein said second mercury switch has twelve internal peripheral electrical contacts equally spaced within, with said mercury pool contacting four adjacent contacts when said second mercury switch is rotated about its center point to a selected orientation of the golfer's hand.

12. The device of claim 8 wherein said first mercury switch has a plurality of internal electrical contacts connected to said selector switch whereby movement of said mercury pool therein causes said first mercury switch to be closed during portions of the swing of the golf club such that wrist position is monitored during the entire swing of the golf club.

13. The device of claim 8 wherein said audible signal producing means is a piezoelectric element activated by an electrical driver, and said cavity is provided with an opening to form a horn for generating said audible signal.

14. A device adapted to be attached to and used on a back of a hand of a golfer for use by a golfer to signal a selected angular wrist roll and wrist bend during the swing of a golf club, said device comprising:

a housing defining an internal cavity, said housing having a rear surface to contact a wrist of the golfer, and a front surface;

an elastic strap connected to said housing adapted for fastening said housing on a back of a hand of the golfer proximate a wrist whereby when worn by the golfer said housing moves according to movement of the wrist, said elastic strap having a longitudinal axis;

a first disk mercury switch defining a disk cavity having a circular perimeter and having twelve equally spaced internal peripheral contacts extending into said disk cavity, and a mercury pool within said disk cavity movable around said circular perimeter to make contact with selected four adjacent of said internal contacts, said first disk mercury switch mounted within said cavity at substantially a center of said housing with a plane of said first disk mercury switch parallel to said bottom surface of said housing, said first disk mercury switch responsive to angular movement of said housing due to angular movement of the wrist;

a second disk mercury switch defining a disk cavity with a circular perimeter and having twelve equally spaced internal peripheral contacts extending into said disk cavity, and a mercury pool within said disk cavity movable around said circular perimeter to make contact with selected four adjacent of said internal contacts, said second disk mercury switch mounted within said cavity at a periphery of said cavity in a plane perpendicular to a plane of said first disk mercury switch, said second disk mercury switch thereby responsive to angular movement of said housing in a direction perpendicular to movement for actuating said first disk mercury switch whereby wrist roll and wrist bend during the swing provides movement of said first and second disk mercury switches;

a battery power source within said cavity connectable to said first and second disk mercury switches;

a selector switch within said housing for selectively connecting and disconnecting said power source to at least one of said first and second disk mercury switches, said selector switch operable by the golfer from exterior said top surface of said housing; and an audible signal producing means within said cavity connected in series with said power source and at least one of said disk mercury switches whereby, when said at least one said disk mercury switch is closed, said audible signal producing means providing an audible signal to the golfer that the selected wrist orientation is achieved during the swing of the golf club.

15. The device of claim 14 wherein said first mercury switch has an alignment pin and is positioned within said cavity at an orientation whereby said first mercury switch is closed when said longitudinal axis of said strap is at an angle of about sixty-two degrees with respect to a golf playing surface and said alignment pin is oriented seventy-five degrees with respect to a line perpendicular to said longitudinal axis of said strap, said perpendicular line being an alignment of a golfer's arm and hand when the golf club is properly gripped whereby said first mercury switch is closed when the golfers wrist is correctly oriented as the golf club strikes a golf ball.

16. The device of claim 14 wherein said first mercury switch has a plurality of internal contacts connected to said selector switch whereby movement of said mercury pool therein causes said first mercury switch to be closed during portions of the swing of the golf club such that wrist position is monitored during the entire swing of the golf club.

* * * * *